US010487539B2

(12) United States Patent
Delande et al.

(10) Patent No.: US 10,487,539 B2
(45) Date of Patent: Nov. 26, 2019

(54) KEY HOUSING

(71) Applicant: VALEO COMFORT AND DRIVING ASSISTANCE, Creteil (FR)

(72) Inventors: Benoît Delande, Creteil (FR); Stéphane Korzack, Creteil (FR); Marc David, Creteil (FR)

(73) Assignee: VALEO COMFORT AND DRIVING ASSISTANCE, Créteil (FR)

( * ) Notice: Subject to any disclaimer, the term of this patent is extended or adjusted under 35 U.S.C. 154(b) by 0 days.

(21) Appl. No.: 14/917,468

(22) PCT Filed: Sep. 9, 2014

(86) PCT No.: PCT/EP2014/069190
§ 371 (c)(1),
(2) Date: Mar. 8, 2016

(87) PCT Pub. No.: WO2015/032977
PCT Pub. Date: Mar. 12, 2015

(65) Prior Publication Data

US 2016/0222696 A1 Aug. 4, 2016

(30) Foreign Application Priority Data

Sep. 9, 2013 (FR) ..... 13 02085

(51) Int. Cl.
*E05B 19/00* (2006.01)
*A45C 11/32* (2006.01)

(52) U.S. Cl.
CPC ..... *E05B 19/0082* (2013.01); *A45C 11/327* (2013.01)

(58) Field of Classification Search
CPC ..... E05B 19/0082; A45C 11/327
See application file for complete search history.

(56) References Cited

U.S. PATENT DOCUMENTS 1,885,957 A * 11/1932 Elwood Singleton Roscoe ..... A45C 11/328 206/37
6,460,386 B1 * 10/2002 Watanuki ..... B60R 25/04 70/408

(Continued)

FOREIGN PATENT DOCUMENTS

DE 100 28 377 A1 2/2001
DE 20 2005 004994 U1 5/2005

(Continued)

OTHER PUBLICATIONS

International Search Report issued in PCT/EP2014/069190 dated Oct. 13, 2014 (3 pages).

(Continued)

*Primary Examiner* — Christine M Mills
*Assistant Examiner* — Amanda L Bailey
(74) *Attorney, Agent, or Firm* — Osha Liang LLP

(57) ABSTRACT

The present invention concerns a key housing, in particular for a motor vehicle key, comprising: —a key (1) comprising an insert (5) and a key head (3) secured to said insert (5), —a housing (7) comprising an insert housing (9) that is longitudinal in shape, intended to receive an insert (5), and a receiving space (70), said key head (3) forming a cover closing the housing (7) at said receiving space (70), and —complementary reversible securing means carried by the housing (7) and by the key (1), allowing said key (1) to be locked onto and unlocked from the housing (7), the housing (7) comprising at least one elastic absorption means (11, 11') in contact with the key (1) in the locked position.

8 Claims, 3 Drawing Sheets

(56) References Cited

U.S. PATENT DOCUMENTS

| | | | | |
|---|---|---|---|---|
| 6,647,752 | B1 * | 11/2003 | Chaillie | A45C 11/324 70/257 |
| 6,672,118 | B1 * | 1/2004 | Wright | A45C 11/32 206/37.3 |
| 7,142,413 | B2 * | 11/2006 | Sugimoto | E05B 19/0082 340/5.62 |
| 7,448,238 | B2 * | 11/2008 | Shimura | B60R 25/04 70/252 |
| 8,359,891 | B2 * | 1/2013 | Fujimoto | E05B 19/0082 70/408 |
| 8,550,364 | B2 * | 10/2013 | Sugimoto | G07C 9/00944 235/380 |
| 9,129,512 | B2 * | 9/2015 | Vigouroux | G08C 17/00 |
| 2005/0166650 | A1 | 8/2005 | Shimura et al. | |
| 2009/0031528 | A1 * | 2/2009 | Zimmer | E05B 15/0205 16/83 |
| 2011/0219831 | A1 | 9/2011 | Hall | |
| 2012/0012659 | A1 * | 1/2012 | Sugimoto | E05L 319/046 235/492 |
| 2012/0039052 | A1 * | 2/2012 | Valles Rangel | G07C 9/00944 361/752 |
| 2012/0092128 | A1 * | 4/2012 | Yamane | E05B 19/0082 340/5.64 |

FOREIGN PATENT DOCUMENTS

| | | | | |
|---|---|---|---|---|
| DE | 102006031727 | A1 * | 1/2007 | H05K 5/02 |
| EP | 0 987 389 | A1 | 3/2000 | |
| EP | 1978188 | A2 * | 10/2008 | E05B 3/04 |
| EP | 2927394 | A1 * | 10/2015 | E05B 19/0082 |
| FR | 2 855 544 | A1 | 12/2004 | |
| FR | 2869935 | A1 * | 11/2005 | G07C 9/00182 |

OTHER PUBLICATIONS

Written Opinion of the International Searching Authority issued in PCT/EP2014/069190 dated Oct. 13, 2014 (5 pages).

* cited by examiner

KEY HOUSING

FIELD OF THE INVENTION

The present invention relates to a key housing, in particular for a motor vehicle, having a key, in particular an emergency key, comprising firstly a key head and an insert and secondly an insert seat for receiving the insert when the key is not in use.

BACKGROUND

In the automobile domain, key housings including an electronic part used to identify a user of the vehicle by exchanging electromagnetic signals and a mechanical part containing an emergency key are known, for example from document EP 0 987 389.

Such housings are particularly practical since they enable the key to be concealed within the very structure of the housing protecting the key. This is particularly advantageous since the user only requires this emergency key in the event of electrical failure, for example a battery failure in the electronic part or a battery failure of the vehicle.

This arrangement also prevents the key insert from snagging in the user's pockets and damaging the user's clothes. This arrangement also makes it possible to significantly reduce the size of the housing.

In document EP 0 987 389, as cited above, the emergency key includes a head forming a gripping portion and a metal insert that can be used as a mechanical emergency key, the head being rigidly attached perpendicular to the metal insert.

To house this emergency key, the housing includes, along one of the edges of same, a seat forming a sheet designed to receive the insert and the key head is clicked onto a corresponding opening of the housing.

Nonetheless, inside the housing, the key may still have some degree of freedom of movement, which may result in unwanted noises and impacts in the event of vibration.

SUMMARY OF THE INVENTION

One of the purposes of the present invention is therefore to propose a housing that at least partially overcomes the drawbacks in the prior art in order to propose a silent key housing.

The present invention therefore relates to a key housing, in particular for a motor vehicle, including:

- a key including an insert and a key head attached to said insert,
- a housing including firstly a longitudinal insert seat that is designed to receive an insert, and secondly a receiving space, said key head forming a cover closing the housing at said receiving space, and
- matching reversible attachment means carried firstly on the housing and secondly on the key, enabling said key to be locked to and unlocked from said housing, the housing has at least one elastic absorption means in contact with the key in the locked position.

On account of this contact with the at least one elastic absorption means, the movements and vibrations of the key are transmitted to the elastic absorption means, which absorbs same and prevents the key from banging against the housing and thereby generating unwanted noise.

According to one aspect of the invention, at least one elastic absorption means is positioned within the insert seat.

According to another aspect of the invention, the at least one elastic absorption means is in contact with the insert when the key is in the locked position.

According to another aspect of the invention, the at least one elastic absorption means is deformed by the insert when the key is in the locked position.

According to another aspect of the invention, the at least one elastic absorption means includes a projection cooperating with a matching notch inside the insert.

This projection and the matching notch mean that the link between the insert and the at least one elastic absorption means is closer and the vibrations and movements of the insert in different directions can be absorbed by the at least one elastic absorption means.

According to another aspect of the invention, the at least one elastic absorption means is a flexible blade oriented along the same axis as the insert seat.

According to another aspect of the invention, at least one elastic absorption means is positioned at the receiving space facing the key head.

According to another aspect of the invention, at least one elastic absorption means is positioned at the key head facing the receiving space.

According to another aspect of the invention, the at least one elastic absorption means is deformed by attaching the key head to the receiving space when the key is in the locked position.

According to another aspect of the invention, the at least one elastic absorption means is an elastomer compressed when the key is in the locked position.

BRIEF DESCRIPTION OF THE DRAWINGS

Other characteristics and advantages of the invention are set out in greater detail in the description below, given by way of non-limiting example and the attached drawings, in which.

Identical elements in different figures are identified using the same reference numbers.

DETAILED DESCRIPTION

Figure 1:
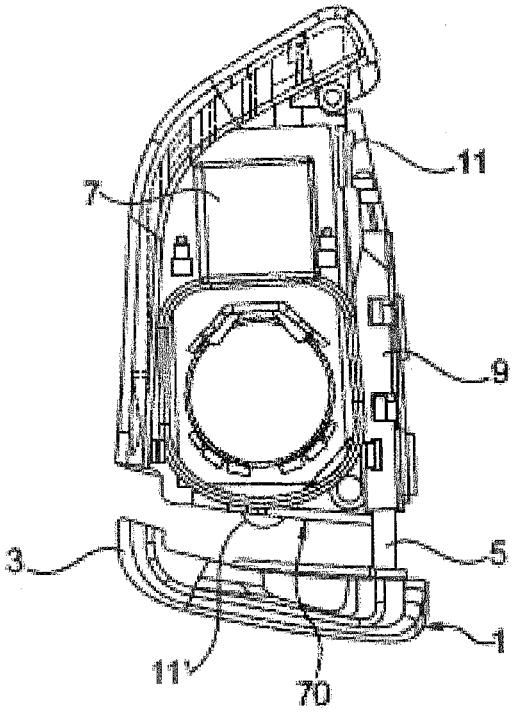
FIG. 1 is a schematic representation of a key housing with the related key in the unlocked position.

FIG. 1 shows a key housing, in particular for a motor vehicle, comprising:

- a key 1 including an insert 5 and a key head 3 attached to said insert 5,
- a housing 7 including firstly a longitudinal insert seat 9 that is designed to receive the insert 5, and secondly a receiving space 70, said key head 3 forming a cover closing the housing 7 at said receiving space 70, and
- matching reversible attachment means (not shown) carried firstly on the housing 7 and secondly on the key 1, enabling said key 1 to be locked to and unlocked from said housing 7.

Figure 2:
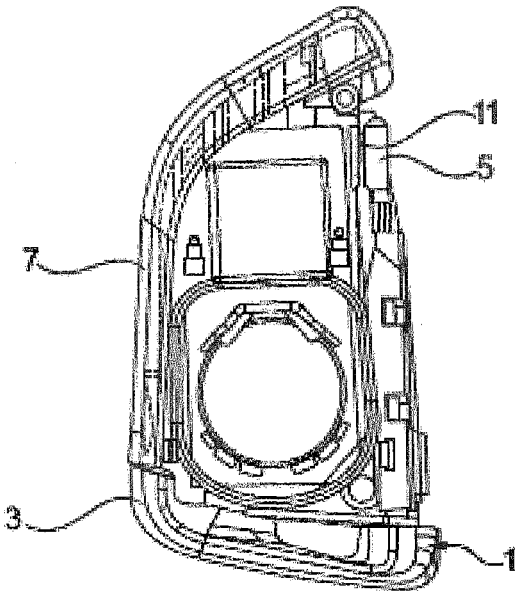
FIG. 2 is a schematic representation of a key housing with the related key in the locked position.

The key housing also includes at least one means 11, 11' for elastically absorbing the movements of the key 1 when the latter is in the locked position, as shown in FIG. 2.

The locked position of the key 1 means that the insert 5 is inserted into the insert seat 9 and that the key head 3 is attached and locked in the receiving space 70 by matching reversible attachment means.

When the key 1 is in the locked position, it is in contact with the at least one elastic absorption means 11, 11'. On account of this contact with the at least one elastic absorption means 11, 11', the movements and vibrations of the key 1 are transmitted to the elastic absorption means 11, 11', which absorbs same and prevents the key 1 from banging against the housing 3 and thereby generating unwanted noise.

The key 1 may be in direct contact with the at least one elastic absorption means 11, 11' or maybe in indirect contact, for example by means of an intermediate element (not shown) that transmits the movements and vibrations of the key 1 to the at least one elastic absorption means 11, 11'.

Figure 3:
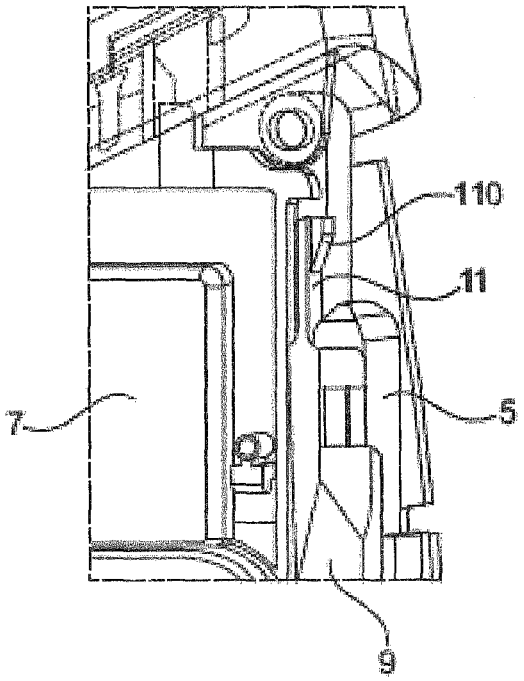
FIG. 3 is a schematic representation of an elastic absorption means with the insert of the key in the unlocked position.
Figure 4:
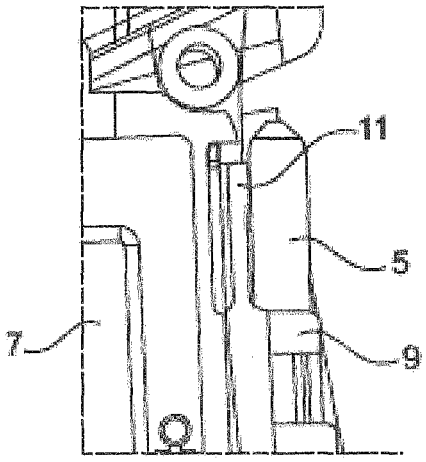
FIG. 4 is a schematic representation of an elastic absorption means with the insert of the key in the locked position.

As shown in FIGS. 3 and 4, the at least one elastic absorption means 11 may be positioned inside the insert seat 9. The at least one elastic absorption means 11 can thus be in contact with the insert 5.

The at least one elastic absorption means 11 may also include a projection 110 that is inserted into a matching notch (not shown in the figures) formed in the insert 5. The projection 110 improves the transmission of the vibrations and movements of the insert 5 to the elastic absorption means 11. Indeed, this projection 110 and the matching notch mean that the link between the insert 5 and the at least one elastic absorption means 11 is closer and the vibrations and movements of the insert 5 in different directions can be absorbed by the at least one elastic absorption means 11.

According to one embodiment shown in FIGS. 3 and 4, the at least one elastic absorption means 11 may for example be a flexible blade 11 oriented along the same axis as the insert seat 9. This flexible blade 11 is linked at one of the extremities of same to the housing 7, with the other extremity of same being free and movable in order to absorb the vibrations and movements of the insert 5.

The insert 5 may simply be in contact with the at least one elastic absorption means 11 when the key 1 is in the locked position, in which case the insert 5 can deform said at least one elastic absorption means 11. The elasticity of the at least one elastic absorption means 11 causes same to exert an opposing force against the insert 5, which limits the movements and vibrations of said insert 5.

The at least one elastic absorption means 11' may also be positioned between the key head 3 and the receiving space 70. The at least one elastic absorption means 11 can then be positioned at the receiving space 70 facing the key head 3, or conversely the at least one elastic absorption means 11' can be positioned at the key head 3 facing the receiving space 70.

Like the at least one elastic absorption means 11 positioned at the insert seat 9, the at least one elastic absorption means 11' positioned between the key head and the receiving space 70 can be deformed when the key 1 is in the locked position, in particular by attaching the key head 3 to the receiving space 70. This at least one elastic absorption means 11' can for example be a projection in the form of a half sphere, and for example made of an elastomer, and that is compressed when the key 1 is in the locked position.

Thus, it is clear that the addition of at least one elastic absorption means 11, 11' enables absorption of the movements and vibrations of the key 1, both in relation to the insert 5 in the insert seat 9 or in relation to the key head 3 against the receiving space 70. The key 1 is therefore held correctly when same is in the locked position and the risk of unwanted noise is reduced.

Figure 5:
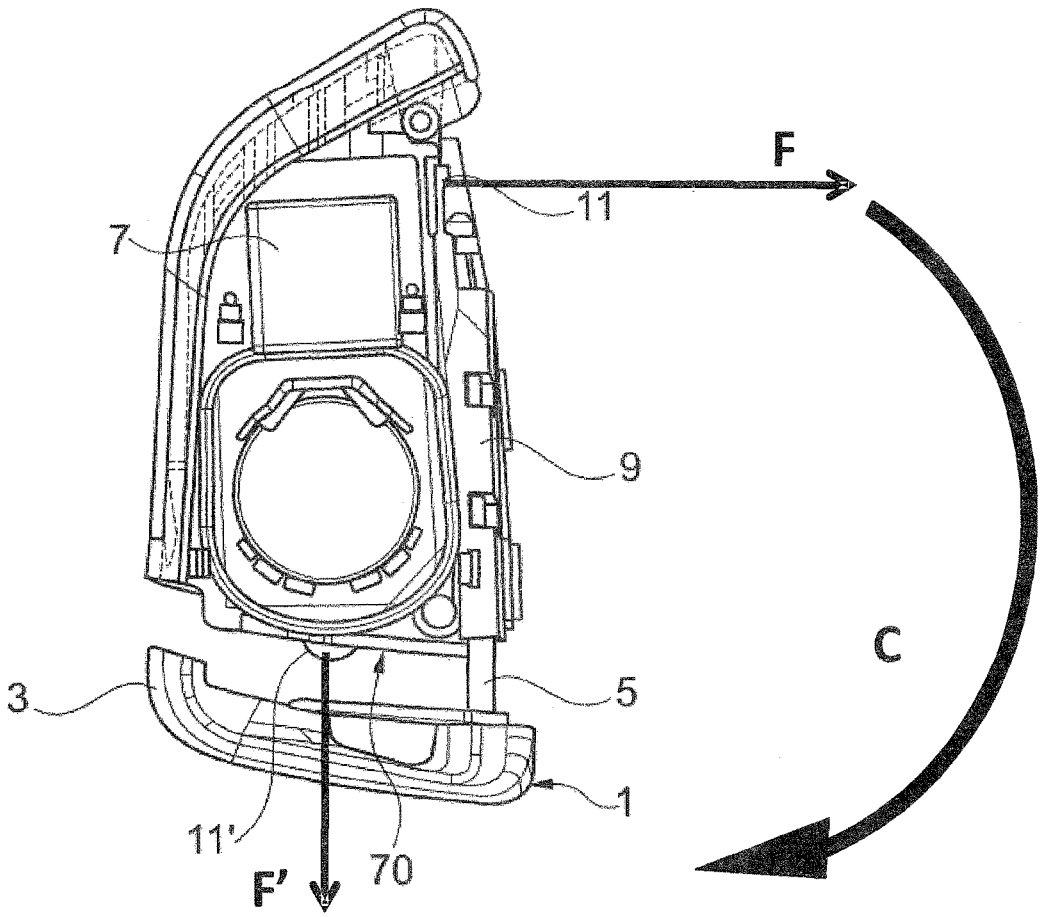
FIG. 5 is a schematic representation of a key in accordance with one or more embodiments of the invention.

Finally, as shown in FIG. 5, the key 1 has a substantially L-shaped structure, i.e. a structure having two portions: a key head 3 and an insert 5, oriented at approximately 90° in relation to one another.

As previously specified, the elastic absorption means 11 positioned inside the insert seat 9, and the elastic absorption means 11' positioned in the receiving space 70 are respectably deformed by the insert 5 and the key head 3 when the key 1 is in the locked position. This addresses the issue of vibrations of the key inside the seat 9 and in the receiving space 70.

The arrangement of the two absorption means as described above enables the invention to better control the cosmetic play between the key head 3 and the housing 7.

Indeed, as shown in FIG. 5, the elastic means 11 positioned inside the insert seat 9, when deformed, exert a force F on the insert 5 that is substantially perpendicular to the longitudinal direction of the insert 5, this force being oriented towards the outside of the housing 7.

The second elastic absorption means 11' positioned between the key head 3 and the receiving space 70, when deformed, exert a second force F' that is substantially perpendicular to the force F.

In consideration of the arrangement of the two elastic means 11, 11' and the degree of deformation of same, the resultant of the forces F, F' exerted on the key 1 generates a torque C that improves the positioning of the key head 3 in relation to the housing 7. Indeed, the torque C acts on the key head 3 to press same against the housing 7 at the receiving space 70.

This enables the invention to better control the cosmetic play between the key head 3 and the housing 7.

The invention claimed is:

1. A key housing device for a motor vehicle, the device comprising:

a key including an insert and a key head attached to said insert; and a housing including a longitudinal insert seat that receives the insert, and a receiving space, said key head forming a cover closing the housing at said receiving space, wherein the housing has at least one elastic absorber in contact with the key in a locked position, wherein a first elastic absorber exerts a first force on the insert that is substantially perpendicular to a longitudinal direction of the insert, the first force being oriented outside the housing, and a second elastic absorber exerts a second force on the key head that is substantially perpendicular to the first force, wherein the first force and the second force generate a torque to position the key in relation to the key housing, wherein the first elastic absorber is a flexible blade oriented along the same axis as the longitudinal insert seat, the flexible blade comprising a first extremity and a second extremity, wherein the flexible blade is fixedly connected at the first extremity to the housing, and wherein the second extremity of the flexible blade is free and movable.

2. The key housing device as claimed in claim 1, wherein the first elastic absorber is positioned inside the longitudinal insert seat.

3. The key housing device as claimed in claim 1, wherein the first elastic absorber is in contact with the insert when the key is in the locked position.

4. The key housing device as claimed in claim 3, wherein the first elastic absorber is deformed by the insert when the key is in the locked position.

5. The key housing device as claimed in claim 2, wherein the first elastic absorber has a projection cooperating with a matching notch inside the insert.

6. The key housing device as claimed in claim 1, wherein the second elastic absorber is positioned at the receiving space facing the key head.

7. The key housing device as claimed in claim 1, wherein the second elastic absorber is deformed by attaching the key head to the receiving space when the key is in the locked position.

8. The key housing device as claimed in claim 1, wherein the second elastic absorber is an elastomer that is compressed when the key is in the locked position.

* * * * *